US005901696A

United States Patent [19]

Hansen

[11] Patent Number: 5,901,696

[45] Date of Patent: May 11, 1999

[54] COOKING RANGE CONTROL PANEL PROTECTION ATTACHMENT

[76] Inventor: Nancy T. Hansen, 815 Sugarbush Ridge, Zionsville, Ind. 46077

[21] Appl. No.: 09/085,870

[22] Filed: May 28, 1998

[51] Int. Cl.[6] ..... F24C 3/00

[52] U.S. Cl. ..... 126/39 M; 126/214 D

[58] Field of Search ..... 126/39 M, 39 R, 126/214 R, 214 D

[56] References Cited

U.S. PATENT DOCUMENTS 3,490,123 1/1970 Clark ..... 126/39 M
5,353,781 10/1994 Calvillo ..... 126/39 M

FOREIGN PATENT DOCUMENTS 2626965 8/1989 France ..... 126/39 M
3427453 2/1985 Germany ..... 126/39 M

*Primary Examiner*—Carroll B. Dority

[57] ABSTRACT

A new cooking range control panel protection attachment for protecting the control panel of a cooking range from the accumulation thereon of dirt and grease. The inventive device includes a generally rectangular elongate panel member having a pair of faces, a pair of opposite ends and a pair of sides extending between the ends of the panel member. One of the faces of the panel member is designed for positioning adjacent a control panel of a cooking range such that the panel member covers the control panel of the cooking range. The panel member has a number of spaced apart holes therethrough extending between the faces of the panel member. Each of the holes is designed for extending a rotating shaft of a control knob of a control panel of a cooking range therethrough.

1 Claim, 3 Drawing Sheets

10
3
2
1

10
13
15
17
3
12
21
19
18
3
16

COOKING RANGE CONTROL PANEL PROTECTION ATTACHMENT

BACKGROUND OF THE INVENTION

1. Field of the Invention

The present invention relates to devices for protecting the control panel of a cooking range from the accumulation thereon of dirt and grease and more particularly pertains to a new cooking range control panel protection attachment for protecting the control panel of a cooking range from the accumulation thereon of dirt and grease.

2. Description of the Prior Art

The use of devices for protecting the control panel of a cooking range from the accumulation thereon of dirt and grease is known in the prior art. More specifically, devices for protecting the control panel of a cooking range from the accumulation thereon of dirt and grease heretofore devised and utilized are known to consist basically of familiar, expected and obvious structural configurations, notwithstanding the myriad of designs encompassed by the crowded prior art which have been developed for the fulfillment of countless objectives and requirements.

Known prior art devices for protecting the control panel of a cooking range from the accumulation thereon of dirt and grease include U.S. Pat. No. 5,438,974; U.S. Pat. No. 4,964,393; PCT Patent No. WO 90/02911 (inventor: Flueckiger); U.S. Pat. No. 4,922,888; U.S. Pat. No. 928,770; PCT Patent No. WO 95/08082 (inventor: Kozdas); and U.S. Pat. No. 3,319,620.

While these devices fulfill their respective, particular objectives and requirements, the aforementioned patents do not disclose a new cooking range control panel protection attachment. The inventive device includes a generally rectangular elongate panel member having a pair of faces, a pair of opposite ends and a pair of sides extending between the ends of the panel member. One of the faces of the panel member is designed for positioning adjacent a control panel of a cooking range such that the panel member covers the control panel of the cooking range. The panel member has a number of spaced apart holes therethrough extending between the faces of the panel member. Each of the holes is designed for extending a rotating shaft of a control knob of a control panel of a cooking range therethrough.

In these respects, the cooking range control panel protection attachment according to the present invention substantially departs from the conventional concepts and designs of the prior art, and in so doing provides an apparatus primarily developed for the purpose of protecting the control panel of a cooking range from the accumulation thereon of dirt and grease.

SUMMARY OF THE INVENTION

In view of the foregoing disadvantages inherent in the known types of devices for protecting the control panel of a cooking range from the accumulation thereon of dirt and grease now present in the prior art, the present invention provides a new cooking range control panel protection attachment construction wherein the same can be utilized for protecting the control panel of a cooking range from the accumulation thereon of dirt and grease.

The general purpose of the present invention, which will be described subsequently in greater detail, is to provide a new cooking range control panel protection attachment apparatus and method which has many of the advantages of the devices for protecting the control panel of a cooking range from the accumulation thereon of dirt and grease mentioned heretofore and many novel features that result in a new cooking range control panel protection attachment which is not anticipated, rendered obvious, suggested, or even implied by any of the prior art devices for protecting the control panel of a cooking range from the accumulation thereon of dirt and grease, either alone or in any combination thereof.

To attain this, the present invention generally comprises a generally rectangular elongate panel member having a pair of faces, a pair of opposite ends and a pair of sides extending between the ends of the panel member. One of the faces of the panel member is designed for positioning adjacent a control panel of a cooking range such that the panel member covers the control panel of the cooking range. The panel member has a number of spaced apart holes therethrough extending between the faces of the panel member. Each of the holes is designed for extending a rotating shaft of a control knob of a control panel of a cooking range therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cooking range control panel protection attachment apparatus and method which has many of the advantages of the devices for protecting the control panel of a cooking range from the accumulation thereon of dirt and grease mentioned heretofore and many novel features that result in a new cooking range control panel protection attachment which is not anticipated, rendered obvious, suggested, or even implied by any of the prior art devices for protecting the control panel of a cooking range from the accumulation thereon of dirt and grease, either alone or in any combination thereof.

It is another object of the present invention to provide a new cooking range control panel protection attachment which may be easily and efficiently manufactured and marketed.

It is a further object of the present invention to provide a new cooking range control panel protection attachment which is of a durable and reliable construction.

An even further object of the present invention is to provide a new cooking range control panel protection attachment which is susceptible of a low cost of manufacture with regard to both materials and labor, and which accordingly is then susceptible of low prices of sale to the consuming public, thereby making such cooking range control panel protection attachment economically available to the buying public.

Still yet another object of the present invention is to provide a new cooking range control panel protection attachment which provides in the apparatuses and methods of the prior art some of the advantages thereof, while simultaneously overcoming some of the disadvantages normally associated therewith.

Still another object of the present invention is to provide a new cooking range control panel protection attachment for protecting the control panel of a cooking range from the accumulation thereon of dirt and grease.

Yet another object of the present invention is to provide a new cooking range control panel protection attachment which includes a generally rectangular elongate panel member having a pair of faces, a pair of opposite ends and a pair of sides extending between the ends of the panel member. One of the faces of the panel member is designed for positioning adjacent a control panel of a cooking range such that the panel member covers the control panel of the cooking range. The panel member has a number of spaced apart holes therethrough extending between the faces of the panel member. Each of the holes is designed for extending a rotating shaft of a control knob of a control panel of a cooking range therethrough.

Still yet another object of the present invention is to provide new cooking range control panel protection attachment that protects the control panel of a cooking range from splatters due to cooking on the range.

Even still another object of the present invention is to provide a new cooking range control panel protection attachment that helps keep a cooking range clean and hygienic.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
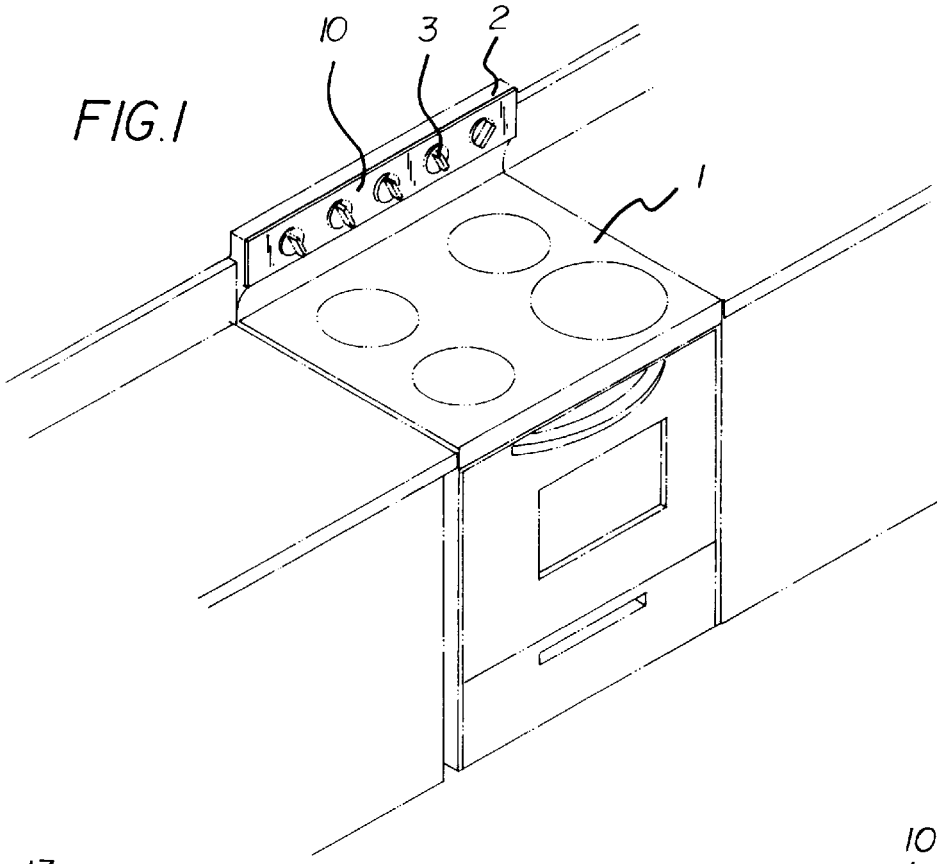
FIG. 1 is a schematic perspective view of a new cooking range control panel protection attachment attached to the control panel of a cooking range according to the present invention.
Figure 2:
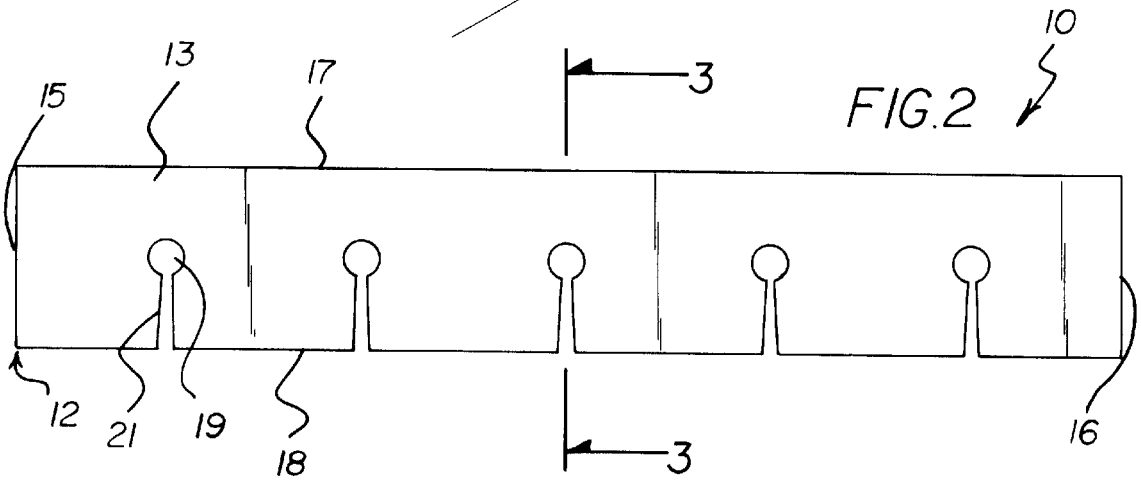
FIG. 2 is a schematic side view of one embodiment of the present invention.
Figure 3:
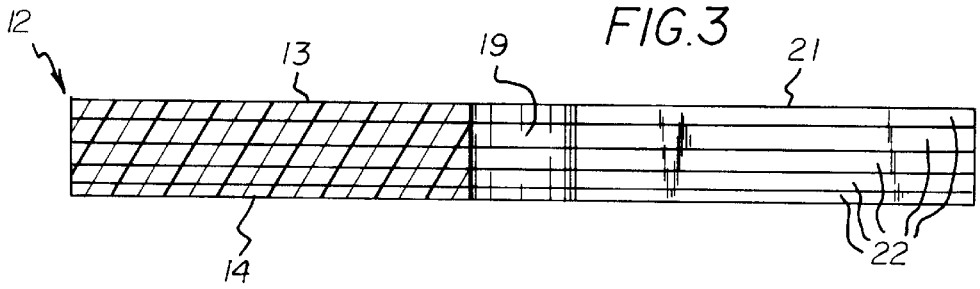
FIG. 3 is a schematic sectional view of the present invention taken from line 3—3 on FIG. 2.

With reference now to the drawings, and in particular to FIGS. 1 through 5 thereof, a new cooking range control panel protection attachment embodying the principles and concepts of the present invention and generally designated by the reference numeral 10 will be described.

As best illustrated in FIGS. 1 through 5, the cooking range control panel protection attachment 10 generally comprises a generally rectangular elongate panel member 12 having a pair of faces 13,14, a pair of opposite ends 15,16 and a pair of sides 17,18 extending between the ends 15,16 of the panel member 12. One of the faces 13,14 of the panel member 12 is designed for positioning adjacent a control panel 2 of a cooking range 1 such that the panel member 12 covers the control panel 2 of the cooking range 1. The panel member 12 has a number of spaced apart holes 19 therethrough extending between the faces 13,14 of the panel member 12. Each of the holes 19 is designed for extending a rotating shaft of a control knob 3 of a control panel 2 of a cooking range 1 therethrough.

In use, the protective cover attachment 10 is designed for attaching to a control panel 2 of a cooking range 1 having a plurality of control knobs 3 rotatably mounted thereto rotating shafts extending from the control panel 2. In closer, detail, the elongate panel member 12 is generally rectangular and has a pair of faces 13,14, a pair of opposite ends 15,16 and a pair of sides 17,18 extending between the ends 15,16 of the panel member 12. One of the faces of the panel member is designed for positioning adjacent a control panel 2 of a cooking range 1 such that the panel member 12 covers the control panel 2 of the cooking range 1.

Figure 4:
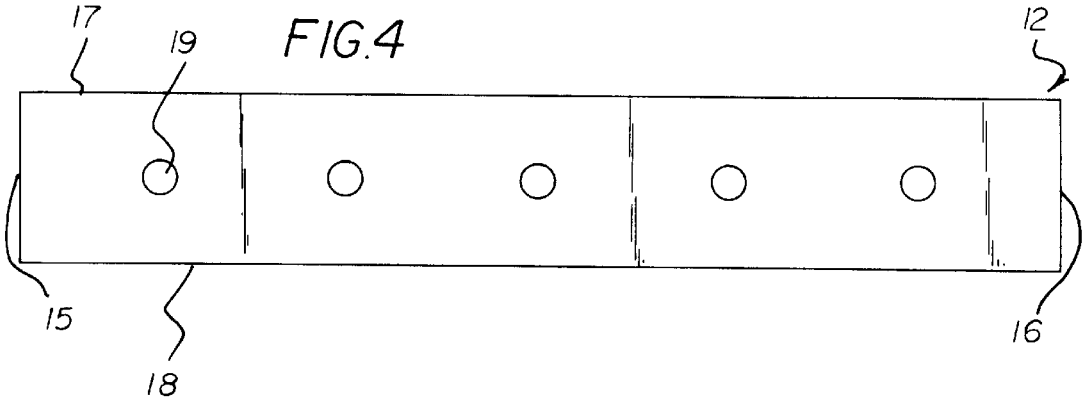
FIG. 4 is a schematic side view of another embodiment of the present invention.

With reference to FIG. 4, the panel member 12 has a number of spaced apart holes 19 therethrough extending between the faces 13,14 of the panel member 12. Each of the holes 19 is designed for extending a rotating shaft of a control knob 3 of a control panel 2 of a cooking range 1 therethrough. In an ideal illustrative embodiment, the number of holes 19 of the panel member 12 comprises five holes 19. Ideally, the holes of the panel member are equidistantly spaced apart from the adjacent holes of the panel member (although it should be recognized that the holes may be spaced apart distances corresponding to the distances between control knobs of a particular brand of cooking range). Each of the holes 19 of the panel member 12 has preferably has a generally circular outer periphery.

Figure 5:
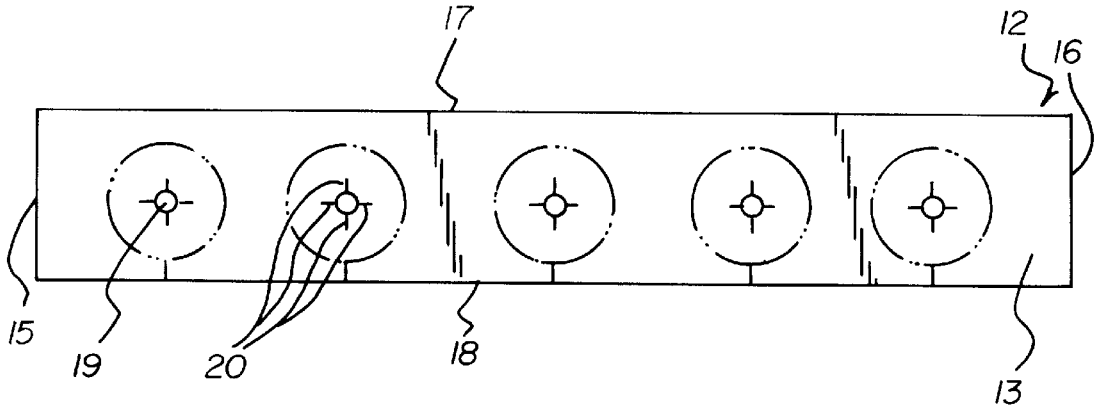
FIG. 5 is a schematic side view of another embodiment of the present invention.

In a preferred embodiment, as illustrated in FIG. 5, each of the holes 19 of the panel member 12 has a number of slits 20 radially extending therefrom through the panel member 12. The slits 20 are designed for aiding extension of a rotating shaft of a control knob 3 therethrough. Preferably, the number of slits 20 for each of the holes 19 of the panel member 12 comprises four slits, Ideally, each pair of adjacent slits 20 of a hole are spaced apart from each other to define an arc along the outer periphery of the associated hole has an angle of about 90 degrees.

In another preferred embodiment, each of the holes 19 of the panel member 12 has an elongate slot 21 through the panel member 12. Each of the slots is extended between the associated hole of the panel member and one of the sides 18 of the panel member 12. Ideally, the widths of each of the slots tapers from the one side of the panel member 12 towards the associated hole of the panel member 12. The slots are designed for slipping over the rotating shafts of the control knobs 3 of a control panel 2 of a cooking range 1 so that the rotating shaft is positioned to extend through the respective hole of the panel member.

Preferably, the panel member 12 has a plurality of separable layers 22 between the faces 13,14 of the panel member 12. Ideally there are at least five separable layers. The layers 22 are designed for removing from the rest of the panel member 12 when the exposed layer on top becomes dirty or worn. Preferably, each layer of the panel member 12 comprises a plastic sheet, ideally, a transparent plastic so that the surface of the control panel may be viewed through the panel member.

In an illustrative embodiment, ideally the panel member 12 has a length defined between the ends 15,16 of the panel member 12 of about 18 inches. In this embodiment, ideally the panel member 12 has a width defined between the sides 17,18 of the panel member 12 of about 4 inches. Finally, in this embodiment, the panel member 12 has a thickness defined between the faces 13,14 of the panel member 12 of about ⅜ inch.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective cover attachment for attaching to a control panel of a cooking range having a plurality of control knobs rotatably mounted thereto, said attachment comprising:

an elongate panel member being generally rectangular and having a pair of faces, a pair of short opposite ends and a pair of elongated sides extending between said ends of said panel member;

one of said faces of said panel member being for positioning adjacent a control panel of a cooking range such that said panel member covers the control panel of the cooking range;

said panel member having a number of spaced apart holes therethrough extending between said faces of said panel member, each of said holes being for extending a rotating shaft of a control knob of a control panel of a cooking range therethrough;

wherein said number of holes of said panel member comprises at least five holes;

wherein said holes of said panel member are equidistantly spaced apart from adjacent holes of said panel member;

each of said holes of said panel member having an outer periphery, said outer periphery of each of said holes of said panel member being generally circular;

each of said holes of said panel member having a plurality of radially extending slits for aiding extension of said control knobs of said control panel therethrough; and wherein said panel member includes a plurality of transparent plastic separable layers for allowing viewing of said control panel therebeneath.

* * * * *